US010500893B2

(12) United States Patent
Johnson

(10) Patent No.: US 10,500,893 B2
(45) Date of Patent: Dec. 10, 2019

(54) SCRIBING-ENGRAVING TOOL HOLDER

(71) Applicant: Mark F Johnson, Harrison, ID (US)

(72) Inventor: Mark F Johnson, Harrison, ID (US)

(73) Assignee: The Tapmatic Corporation, Post Falls, ID (US)

( * ) Notice: Subject to any disclaimer, the term of this patent is extended or adjusted under 35 U.S.C. 154(b) by 72 days.

(21) Appl. No.: 15/697,327

(22) Filed: Sep. 6, 2017

(65) Prior Publication Data

US 2019/0070892 A1 Mar. 7, 2019

(51) Int. Cl.
*B44B 3/06* (2006.01)

(52) U.S. Cl.
CPC ..... *B44B 3/063* (2013.01)

(58) Field of Classification Search
CPC ..... B44B 3/063
USPC ..... 33/18.1
See application file for complete search history.

(56) References Cited

U.S. PATENT DOCUMENTS 4,687,390 A * 8/1987 Samis ..... B23Q 35/20 33/24.2
4,809,023 A * 2/1989 Brunner ..... B43K 21/027 33/18.1
6,427,357 B1 * 8/2002 Piper ..... B44B 3/061 33/18.1
7,707,731 B2 * 5/2010 Johnson ..... B44C 1/24 33/18.1
2004/0060180 A1 * 4/2004 Nelson ..... B44B 3/063 33/18.1
2010/0058604 A1 * 3/2010 Johnson ..... B44B 5/0061 33/679
2011/0135416 A1 * 6/2011 Fry ..... B23B 31/265 409/232
2015/0153149 A1 * 6/2015 Pettersson ..... B25J 18/00 33/503
2016/0336833 A1 * 11/2016 Ulyanov ..... H02K 7/145
2019/0070892 A1 * 3/2019 Johnson ..... B44B 3/063

* cited by examiner

*Primary Examiner* — Yaritza Guadalupe-McCall
(74) *Attorney, Agent, or Firm* — Wells St. John P.S.

(57) ABSTRACT

Disclosed is a scribing or engraving tool for use to mark, scribe or engrave using a a CNC, engraving or other automated machine. More particularly some examples of the invention include a coolant passageway for providing coolant to the stylus, and others provide a second spring which engages when desired for applying more pressure to the toolbit when desired. In yet another embodiment a coupling system may be used to provide for the rotation of the stylus holder and stylus to provide for engraving.

15 Claims, 13 Drawing Sheets

SCRIBING-ENGRAVING TOOL HOLDER

CROSS REFERENCE TO RELATED APPLICATION

This application does not claim priority from any other application.

TECHNICAL FIELD

This invention pertains to engraving or scribing tools and tool holders.

BACKGROUND OF THE INVENTION

When machining or otherwise working a workpiece on a numerical control machine, engraving machine or other mill, it is desirable to be able to scribe or engrave information into the workpiece. Typically this is accomplished by programming the machine and involves moving the tool to the surface of the workpiece, applying pressure as the stylus is moved along the surface of the workpiece to create the desired pattern.

When the term stylus is used herein, it refers to what may be referred to as a stylus, a toolbit, cutting tool (in some engraving applications or embodiments), or simply a tool that makes the marking on the workpiece.

The depth of the resulting engraved pattern depends in part on the hardness or softness of the material and the pressure applied to the material through the stylus. It is desirable in many cases to assure that the desired amount of pressure applied through the stylus remains constant so you have a constant indentation, cavity or other groove made by the stylus (for aesthetics or other reasons).

It is often times desirable to change the stylus for the next job or application, and current typical tool holders require that the entire tool holder be taken apart in order to make the change. It is an objective of one embodiment of this invention to provide a tool holder which allows the stylus to be more easily removed by simply removing the lower stylus sleeve and replacing the stylus with the desired stylus or tool for the next application.

With many typical engraving tool holders, if the user wants to mark or scribe harder materials they generally currently partly disassemble the tool holder and replace the standard springs with stronger ones, which makes it desirable to come up with a solution which would not require the replacement of the standard springs. Embodiments of this invention have the advantage of providing a first spring and then a second flexure spring, the second flexure spring only engaging when needed to provide additional force at the heaviest or heavier force settings required for the particular workpiece.

Depending on the usage, pressure, depth, workpiece and other factors, parts of the tool holder or engraver (for example such as the stylus or tool bit) become hotter than desired.

It is therefore desirable to provide some type of coolant fluid and/or lubricant through the tool holder and to the stylus. It is an object of some embodiments of this invention to provide an internal coolant and/or lubrication system which provides the appropriate coolant to the stylus during operations. The internal coolant provided may also be utilized in some embodiments of this invention to provide additional hydraulic force to the stylus or tool bit.

It is also desirable in some applications of some embodiments to provide a tool holder that includes an integral shank feature for use in some applications. This application or embodiment would not be intended nor be able to be held in a collet or end mill tool holder, but has other applications as will become evident to one of ordinary skill in the art from reviewing the various embodiments of this invention described below. It is therefore another object of some embodiments of this invention to provide a scribing or engraving tool holder which includes an integral shank.

It is an object of applications of some embodiments of this invention to provide a scribe which does not rotate, and yet in other embodiments it is an object to provide more of an engraver wherein the stylus rotates, and embodiments of this invention provide an effective coupling system to provide for the rotation of the stylus.

It is still further an object of embodiments of this invention to provide for such a scriber/engraver that the preset force on the stylus can be set and adjusted to a number of different forces, and one which optionally includes a gauge readout to allow the user to more easily set the force to pre-determined values consistently. The advantage of having a scale on the tool holder to facilitate this provides an improved way to consistently achieve repeatable forces on the stylus.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 9 is a cross-section elevation view of an application of a stylus holding option for embodiments of this invention, the stylus holding option only requires the stylus to be slid into the stylus sleeve, fixed in by a fastener such as a screw;

FIG. 10 is close-up view detail 10 from FIG. 9;

FIG. 11 is an elevation view of an application of another stylus holding option wherein the stylus is braized into the stylus sleeve;

FIG. 12 is section 12-12 from FIG. 11;

FIG. 13 is a cross-section elevation view of another application of a stylus holding option for embodiments of this invention, the stylus holding option including the use of a collet to secure and unsecure the stylus tool;

FIG. 14 is detail 14 from FIG. 13;

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
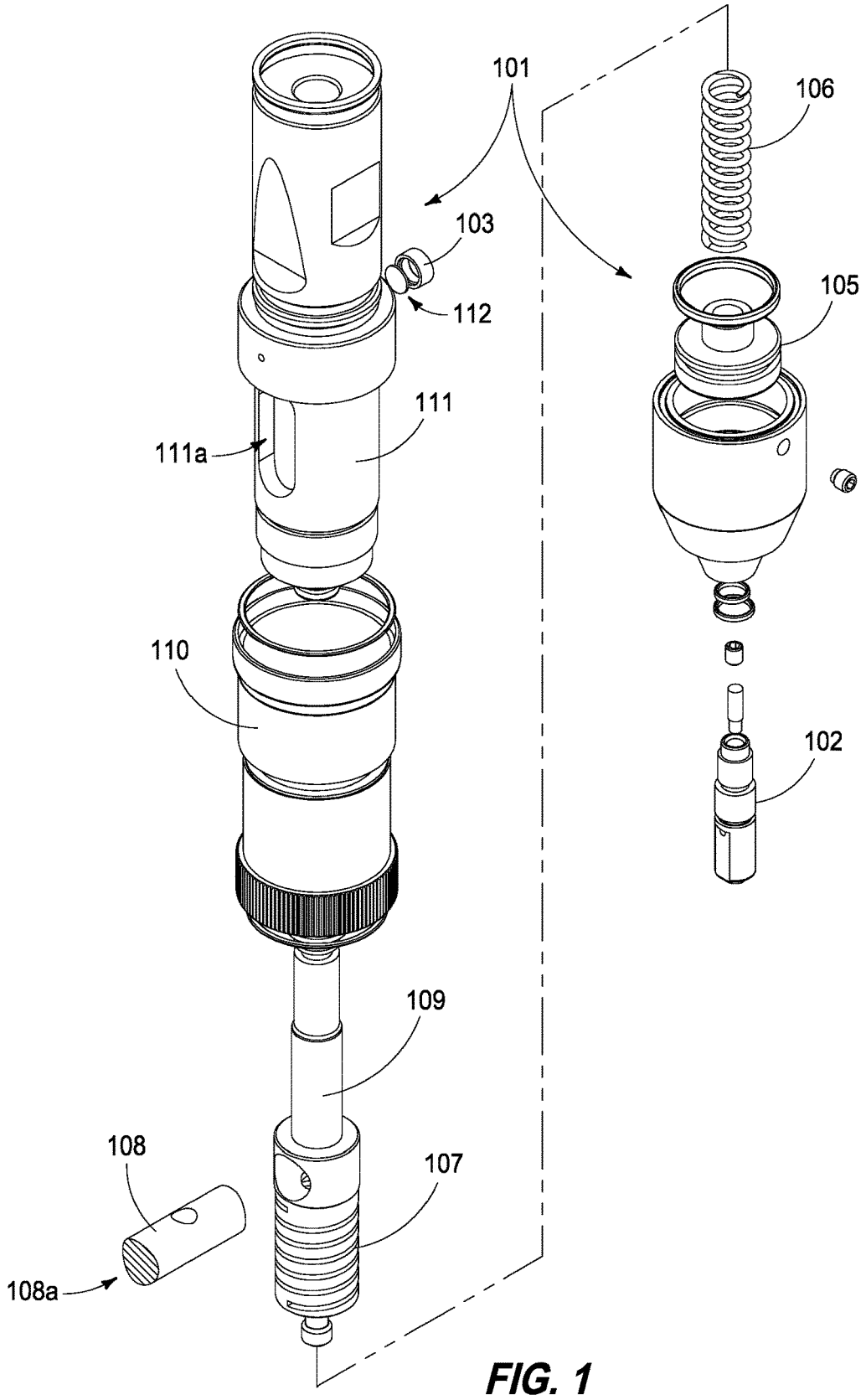
FIG. 1 is a perspective exploded view of one embodiment of this invention.

FIG. 1 is a perspective exploded view of an example of a scribing or engraving tool holder as contemplated by at least one embodiment of this invention, illustrating a scribing/engraving tool holder 101, body 111, magnification bubble 112, magnification bubble retainer 103, identification sleeve 110, flexure spring 109 with helical coil portion 107, compression adjustment abutment 108, return spring 106, stylus holder 105, and stylus sleeve 102.

Figure 2:
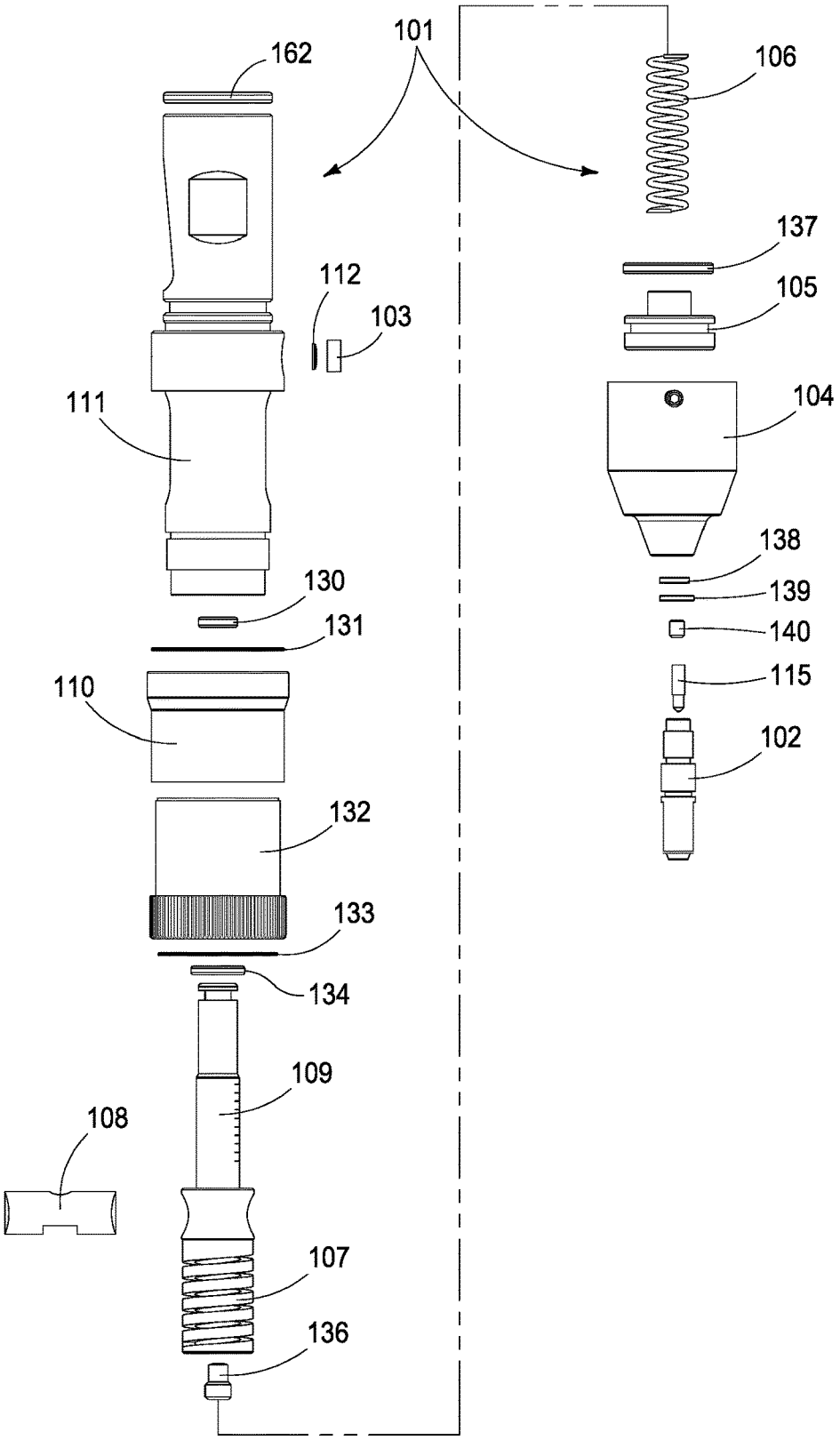
FIG. 2 is an exploded elevation view of the embodiment of the invention illustrated in FIG. 1.

FIG. 2 is an exploded elevation view of the embodiment of the invention illustrated in FIG. 1, scribing/engraving tool holder 101, O-ring 162, body 111, magnification bubble 112, magnification bubble retainer 103, O-ring 130, O-ring 131, identification sleeve 110, adjustment sleeve 132, O-ring 133, O-ring 134, flexure spring 109 with helical coil portion 107, screw pin 136, compression adjustment abutment 108, return spring 106, O-ring 137, stylus holder 105, stylus guide 104, O-ring 138, O-ring 139, set screw 140, stylus 115 and stylus sleeve 102.

Figure 3:
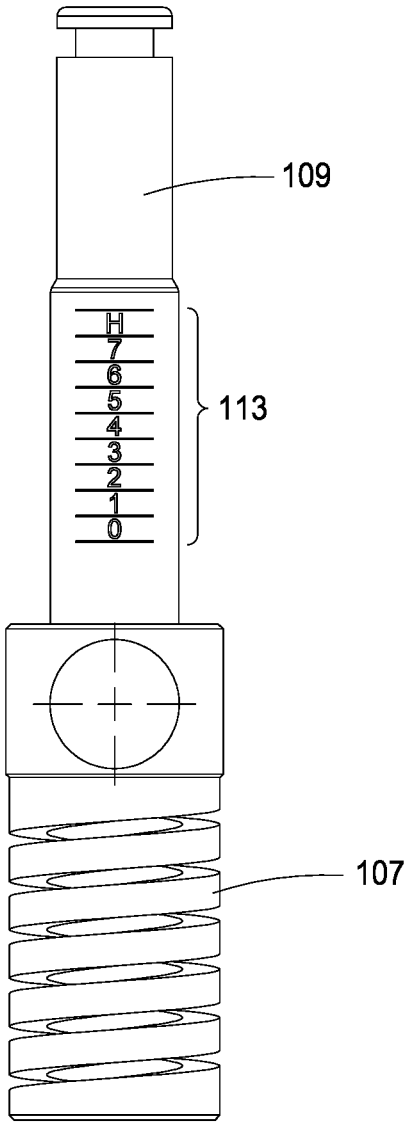
FIG. 3 is a close-up elevation view of the embodiment of the flexure spring shown in FIG. 2, to illustrate the scale with graduations for setting pre-loaded force.

FIG. 3 is a close-up elevation view of the embodiment of the flexure spring 109 (with helical coil portion 107) shown in FIG. 2, to illustrate the scale 113 with graduations for setting pre-loaded force. As will be described more fully below, the adjustment sleeve 132 includes internal threads that are engaged with external threads on the faces 108*a* of the compression adjustment abutment 108. The compression adjustment abutment 108 is guided in the body 111 by guides 111*a* so that when adjustment sleeve 132 is turned, compression adjustment abutment 108 moves axially (shown in FIGS. 6-8) to eventually apply increasing pressure on the stylus holder 105. The magnification bubble 112 shows the user operator the scaled 113 level of preload force applied.

Figure 4:
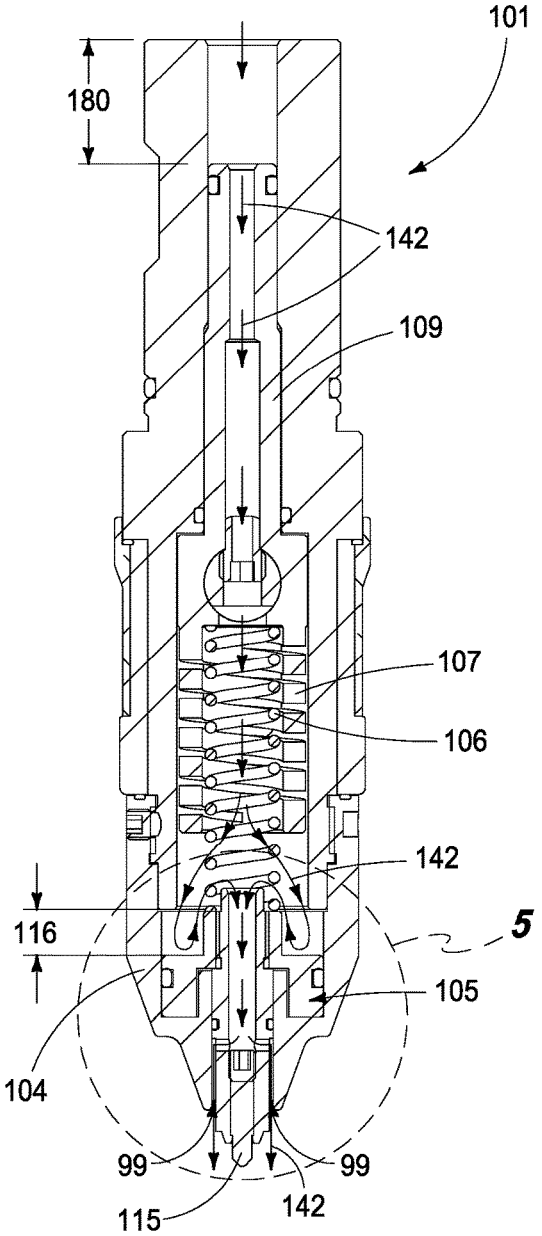
FIG. 4 is a cross-section elevation view of the embodiment of the invention illustrated in FIG. 1 wherein the stylus is not in contact with the workpiece.

FIG. 4 is a cross-section elevation view of the embodiment of the invention illustrated in FIG. 1 in a position wherein the stylus 115 is not in contact with a workpiece. FIG. 4 shows scribing/engraving tool holder 101, body 111, flexure spring 109 with helical coil portion 107, return spring 106, stylus holder 105, stylus sleeve 102, stylus 115 and stylus guide 104. Distance 116 shows a distance between stylus holder 105 and body 111, which said distance 116 will vary depending on the compression applied to the stylus by the work piece and the compression of the springs, as shown and more fully described in later figures. Arrows 142 illustrate one example of where coolant passageways may be positioned and/or utilized to provide coolant to the stylus.

Figure 5:
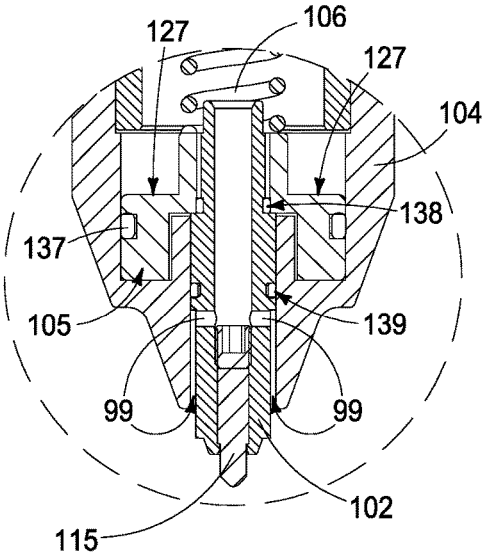
FIG. 5 is close-up view detail 5 from FIG. 4.

FIG. 4 also shows, and FIG. 5 also illustrates, coolant outlet apertures 99 in the stylus sleeve 102, as well as O-rings 138 and 139, which provide sealing for the coolant passageway.

FIG. 5 is close-up view 5 from FIG. 4, and illustrates stylus guide 104, return spring 106, coolant outlet apertures 99 in the stylus sleeve 102, O-ring 139, O-ring 138, surface 127 on stylus holder 105 (against which coolant being pushed toward the coolant outlets 99 may apply force to increase the force on the stylus 115 and consequently the force applied by the stylus 115 to a workpiece. The various O-rings shown in FIGS. 1-5 provide sealing so that an internal coolant may be used. In the embodiments in which an internal coolant or lubricant is used, the coolant may be introduced through the top of the shank and would then flow out through the coolant outlet apertures 99 in the stylus sleeve 102—such as shown in FIG. 4 (the coolant is item 142). The coolant will provide better cooling and lubrication for the scribing process. Additionally, the pressure from the coolant may also be used to increase the marking force through the stylus as the pressure force would be applied to the stylus holder at or on surface 127, as shown in FIG. 5.

Figure 6:
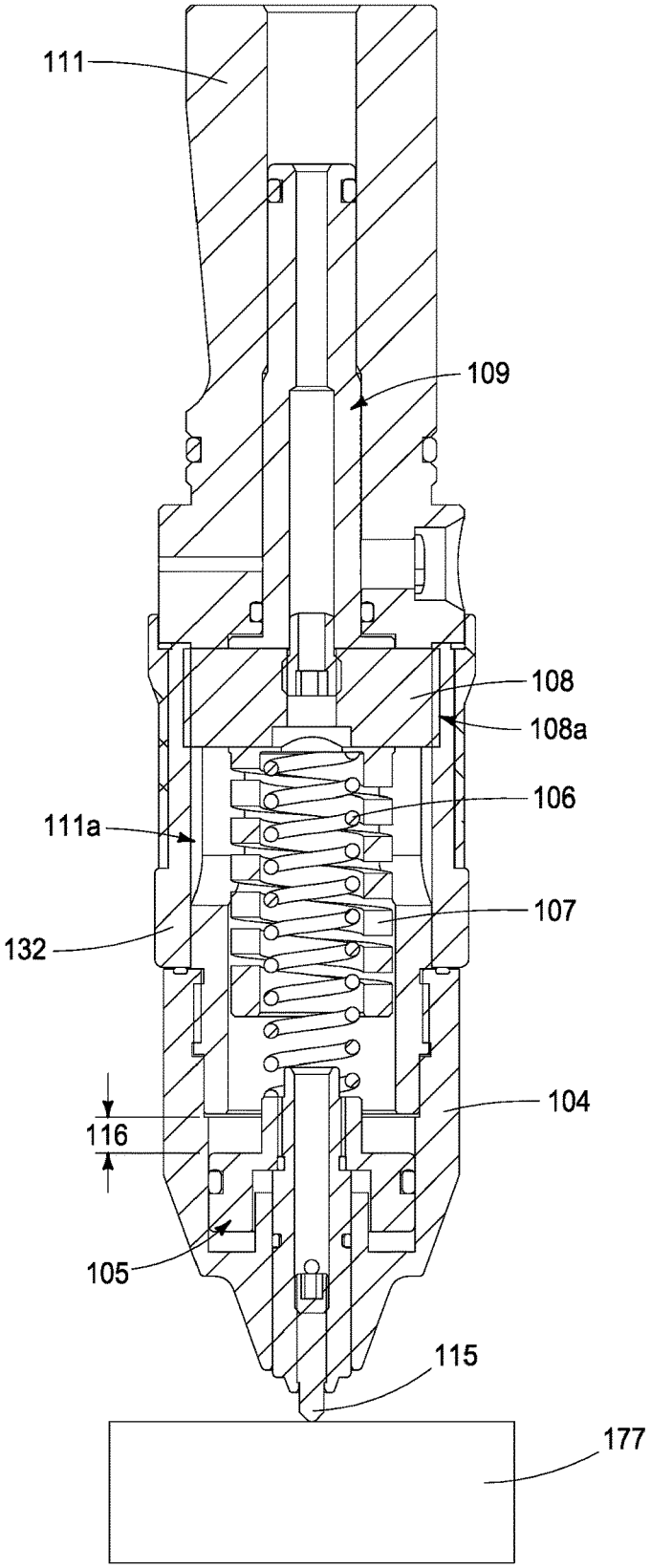
FIG. 6 is a cross-section elevation view of the embodiment of the invention shown in FIG. 4, wherein the adjustment abutment is in the lowest setting or lowest force against the stylus part and the stylus is compressed against the workpiece.

FIG. 6 is a cross-section elevation view of the embodiment of the invention shown in FIG. 4, wherein the adjustment abutment 108 is in the lowest setting or lowest force against the stylus part and the stylus 115 is compressed against the workpiece 177. FIG. 6 shows body 111, stylus guide 104, helical portion 107 of the flexure spring. In the embodiment illustrated in FIG. 6, the compression adjustment abutment 108 and the inside of the adjustments sleeve 132 are threaded so that by means of turning the adjustment sleeve 132, the adjustment abutment 108 will be lowered in the slot 111*a*, thereby compressing spring 106 and increasing the force against the stylus holder 105 and stylus 115. The threaded face 108*a* of compression adjustment abutment 108 is also shown. FIG. 6 shows the adjustment abutment 108 in the lowest setting for the lowest force to be applied against the stylus parts, and shows the stylus 115 compressed against the workpiece 177, for marking. In some embodiments of this invention, there may be about 0-5 mm of compression allowed.

Figure 7:
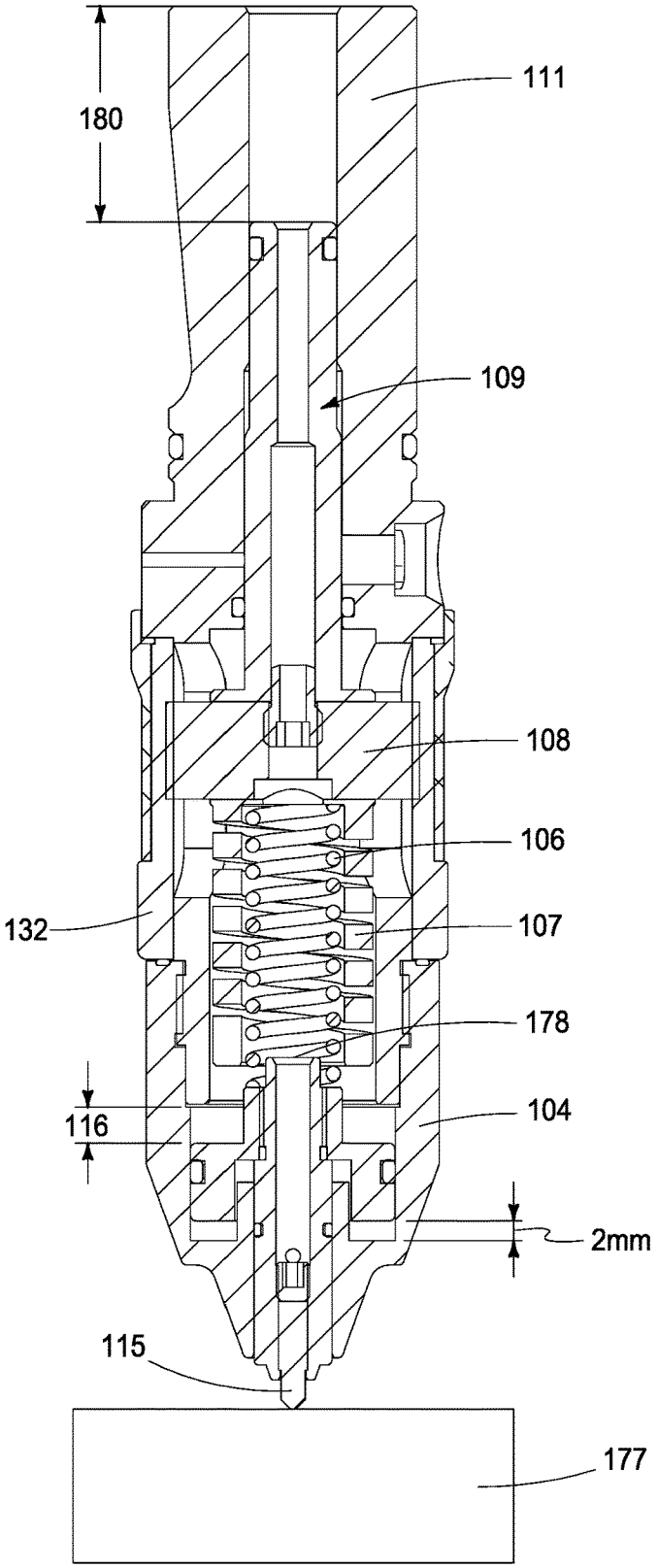
FIG. 7 is a cross-section elevation view of the embodiment of the invention shown in FIGS. 4-6, wherein the adjustments sleeve has been turned to move the compression adjustment abutment downwardly to increase the preloaded force exerted by spring 106 against the stylus, which is compressed against the workpiece.

FIG. 7 is a cross-section elevation view of the embodiment of the invention shown in FIGS. 4-6, wherein the adjustment sleeve 132 has been turned to move the compression adjustment abutment 108 downwardly to increase the preloaded force exerted by spring 106 against the stylus 115, which is compressed against the workpiece 177. FIG. 7 shows body 111, stylus guide 104, helical portion 107 of the flexure spring. Distance 116 has been reduced as compared to distance 116 in FIG. 4 for example, and distance 180 is shown as a result of the downwardly applied force compression of the spring 106.

In this example of an embodiment of the invention, the adjustment sleeve 132 has been turned to move compression adjustment abutment 108 down by about 6 mm (0.24 inches), thereby increasing the preload force exerted by spring 106 against the stylus parts, and the stylus 115 is compressed against the workpiece by about 2 mm (0.08 inches).

Figure 8:
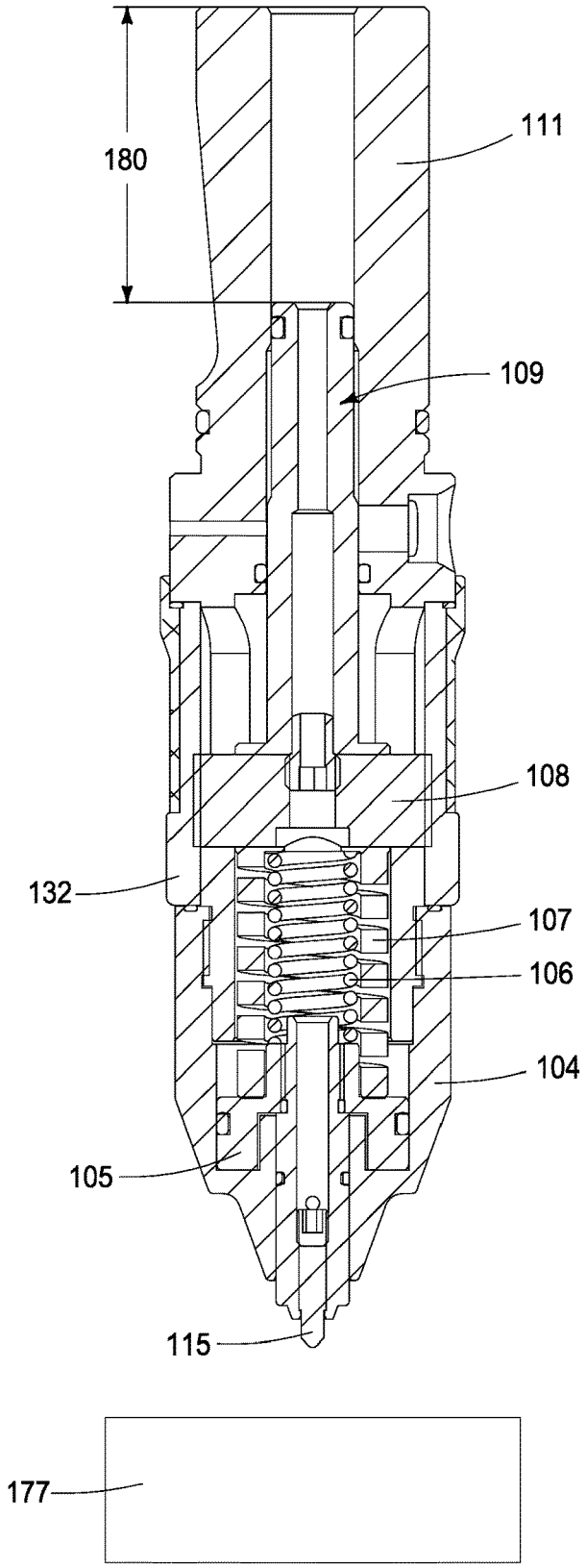
FIG. 8 is a cross-section elevation view of the embodiment of the invention shown in FIGS. 4-7, wherein the adjustments sleeve is turned until adjustment abutment 108 reaches its maximum travel, thereby engaging flexure spring to make contact with the high pressure to the stylus holder and provide additional pressure on the workpiece.

FIG. 8 is a cross-section elevation view of the embodiment of the invention shown in FIGS. 4-7, wherein the adjustments sleeve 132 is turned until adjustment abutment 108 reaches its maximum travel, thereby engaging helical coil portion 107 of flexure spring 109 such that it makes contact to apply higher pressure to the stylus holder 105, stylus 115 and thereby providing additional pressure on the workpiece 177. FIG. 8 shows body 111, stylus guide 104, spring 106, helical portion 107 of the flexure spring 109, distance 180 and adjustment sleeve 132.

With the adjustment sleeve 132 turned until the adjustment abutment 108 reaches its maximum travel, flexure spring 109 makes contact with stylus holder 105. In this position, the spring 106 and the helical coil portion 107 of flexure spring 109 are both applying force to the stylus parts for greatly increased marking pressure, which may be needed or desired on hardened materials.

In FIG. 8, the adjustment sleeve 132 is turned until compression adjustment abutment 108 reaches its maximum travel, and the helical coil portion 107 of the flexure spring 109 makes contact with stylus holder 105. In this position both the spring 106 and the flexure helical spring coils 107 are applying force to the stylus parts for greatly increased marking pressure or force, which may be desired when marking harder workpieces 177.

Figure 9:
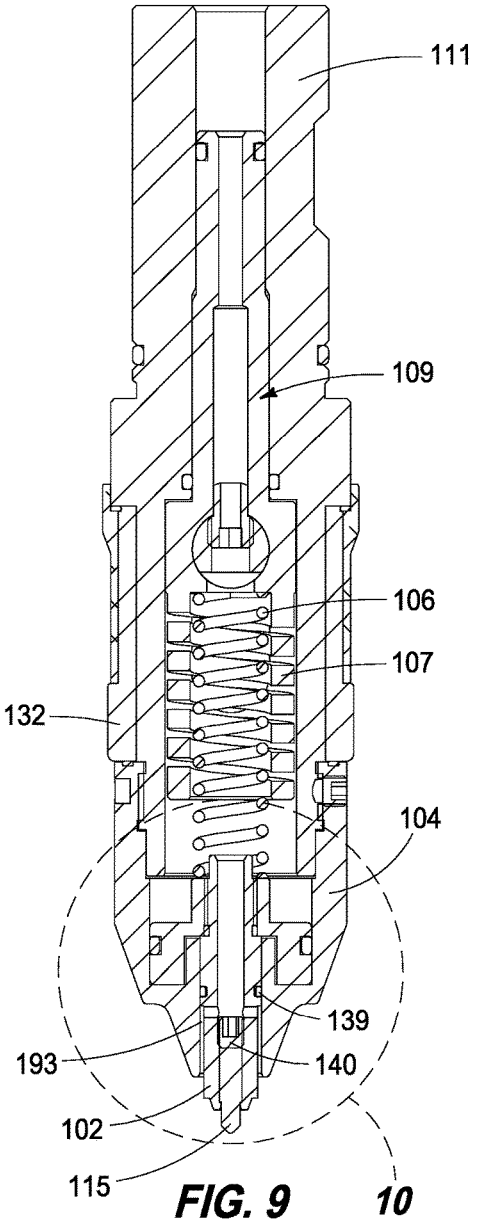
FIGS. 9-14 illustrate various holding options for holding or securing the stylus or tool bit, depending upon the embodiment of the invention and the needs of the application, as described more fully below.

FIGS. 9-14 illustrate various holding options for holding or securing the stylus 115 or tool bit, depending upon the embodiment of the invention and the needs of the application, as described more fully below FIG. 9 is a cross-section elevation view of an application of a stylus holding option for embodiments of this invention, the stylus holding option only requires the stylus 115 to be slid into the stylus sleeve 102, fixed in by a fastener such as a screw 140. FIG. 9 further shows body 111, spring 106, helical coil portion 107 of flexure spring 109, stylus sleeve 102, coolant outlet channel 193 and O-ring 139.

Figure 10:
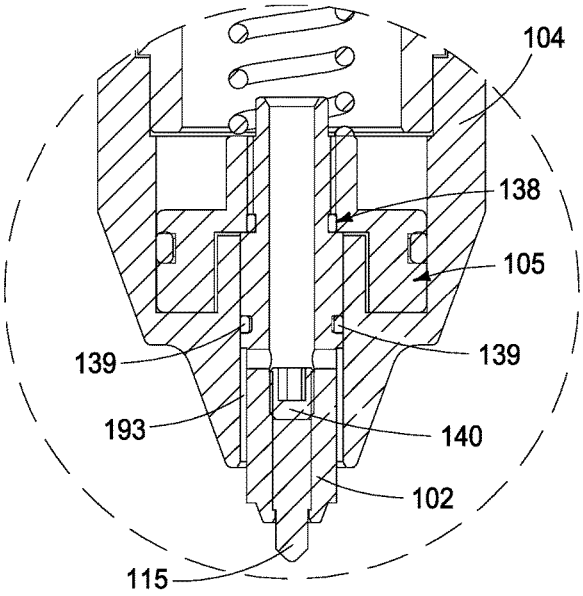

FIG. 10 is detail 10 from FIG. 9, and illustrates stylus 115, stylus sleeve 102, stylus holder 105, fastener screw 140, O-ring 138, O-ring 139, and coolant outlet channel 193.

FIGS. 9-10 show a stylus holding option wherein the stylus 115 may be slid into stylus sleeve 102 stopping against or until it abuts a shoulder in the stylus sleeve 102. Screw 140 is to fix the stylus 115 in place and O-ring 139 seals the stylus sleeve so that internal coolant can flow out through the channels 193 as shown.

Figure 11:
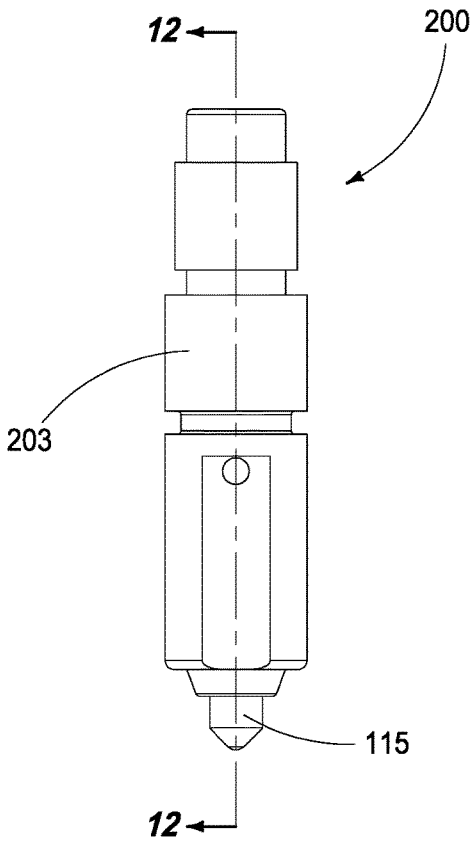
Figure 12:
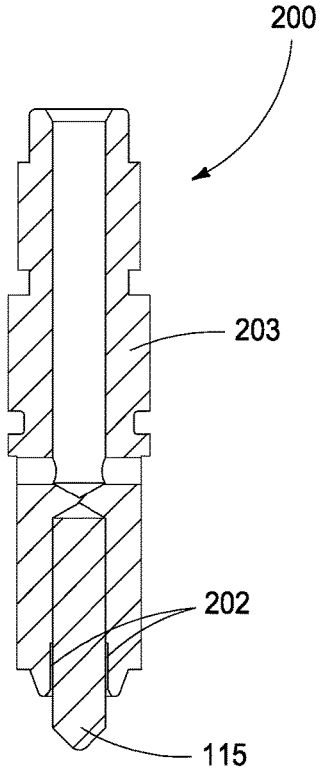

FIGS. 11 and 12 show another stylus holding option 200, wherein the stylus is braized into the stylus sleeve. FIG. 11 is an elevation view of an application of option 200 wherein the stylus 115 is braized into the stylus sleeve 203. The braize 202 is shown in one location but may be in other locations depending on the embodiment.

FIG. 12 is section 12-12 from FIG. 11, and shows the stylus holding option 200, stylus sleeve 203 and stylus 115.

Figure 13:
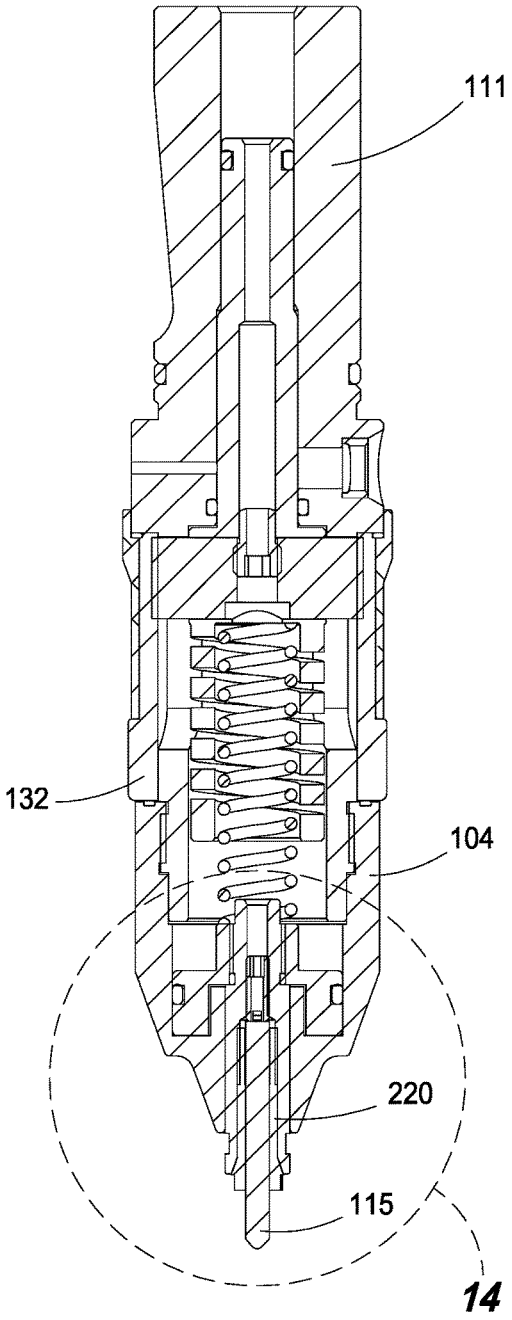
Figure 14:
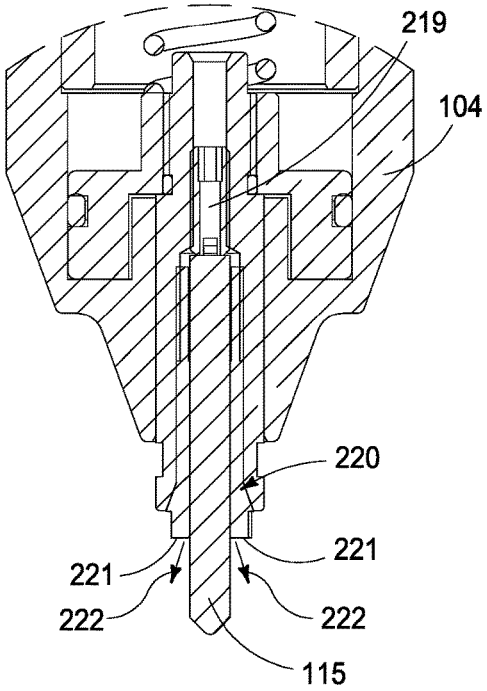

FIGS. 13 and 14 show another example of an embodiment of a stylus holding option, wherein the stylus tool is held in a collet 220. FIG. 13 is a cross-section elevation view of this application of a stylus holding option for embodiments of this invention, the stylus holding option including the use of a collet 220 to secure and unsecure the stylus tool. FIG. 13 illustrates body 111, adjustment sleeve 132, collet 220, stylus 115 and stylus guide 104.

A coolant system may also be provided with the embodiment shown in FIG. 13, in similar fashion and route to that shown and described above with respect to FIG. 4, only the coolant outlets around the stylus will be through the slots that are in the collet 220.

FIG. 14 is detail 14 from FIG. 13. FIG. 14 illustrates collet 220, stylus 115, stylus guide 104, coolant discharge through collet aperture 221 with coolant 222 being discharged therefrom. This embodiment shown in FIGS. 13-14 includes an adjustment screw 219 for adjusting the position or length of the stylus tool 115 in the collet and also provides solid support so that the stylus tool 115 cannot move back in the collet 220 during the marking process.

In the embodiment shown in FIGS. 15-18, the stylus holder 307 and stylus 115 may rotate with the body of the tool holder and the shank is shown integral with the tool holder body. It is shown with what is referred to as an HSK shank as an example; however, it should be noted that it may also be combined with a variety of other shanks, including Capto, and steep taper shanks like CAT, BT and SK shanks.

Figure 15:
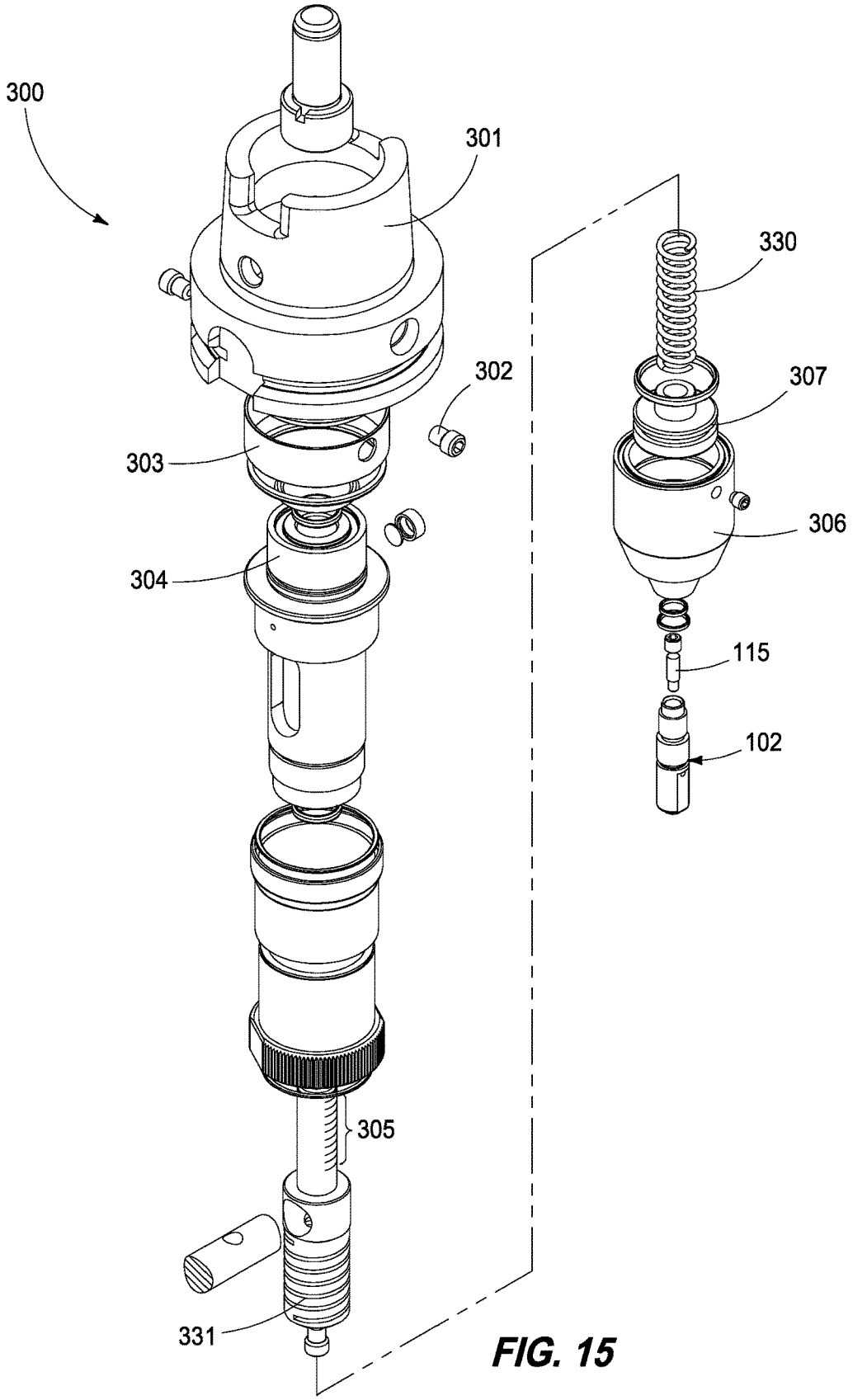
FIG. 15 is a perspective exploded view of another embodiment of this invention which may be used as engraver wherein the stylus holder and stylus may rotate with the body of the tool holder and the shank is integral with the tool holder body.

FIG. 15 is a perspective exploded view of another embodiment of this invention 300, and said embodiment provides the flexibility such that the embodiment may be used as engraver. The shank 301 is fixed to the body 304 using a threaded connection and a strong bonding agent. Spot holes may be drilled into the body 304 so that it may be additionally fixed with screws 302. These may also be assembled with a bonding agent which would provide a security measure to prevent any users from ever disassembling the shank 301 from the body 304, essentially making the two parts one-piece or an integral shank tool.

It should be noted that in some embodiments of this invention the shank 301 may be integral with the body 304, and in others the body may be configured to be held by a collet, tool holder, or other receiving component of an engraving or CNC machine, all within the contemplation of embodiments of this invention.

FIG. 15 further shows stylus 115, stylus guide 306, spring 330, flexure spring with helical portion 331, force scale 305, screws 302, body 304, screw covering sleeve 303 and stylus holder 307.

Figure 16:
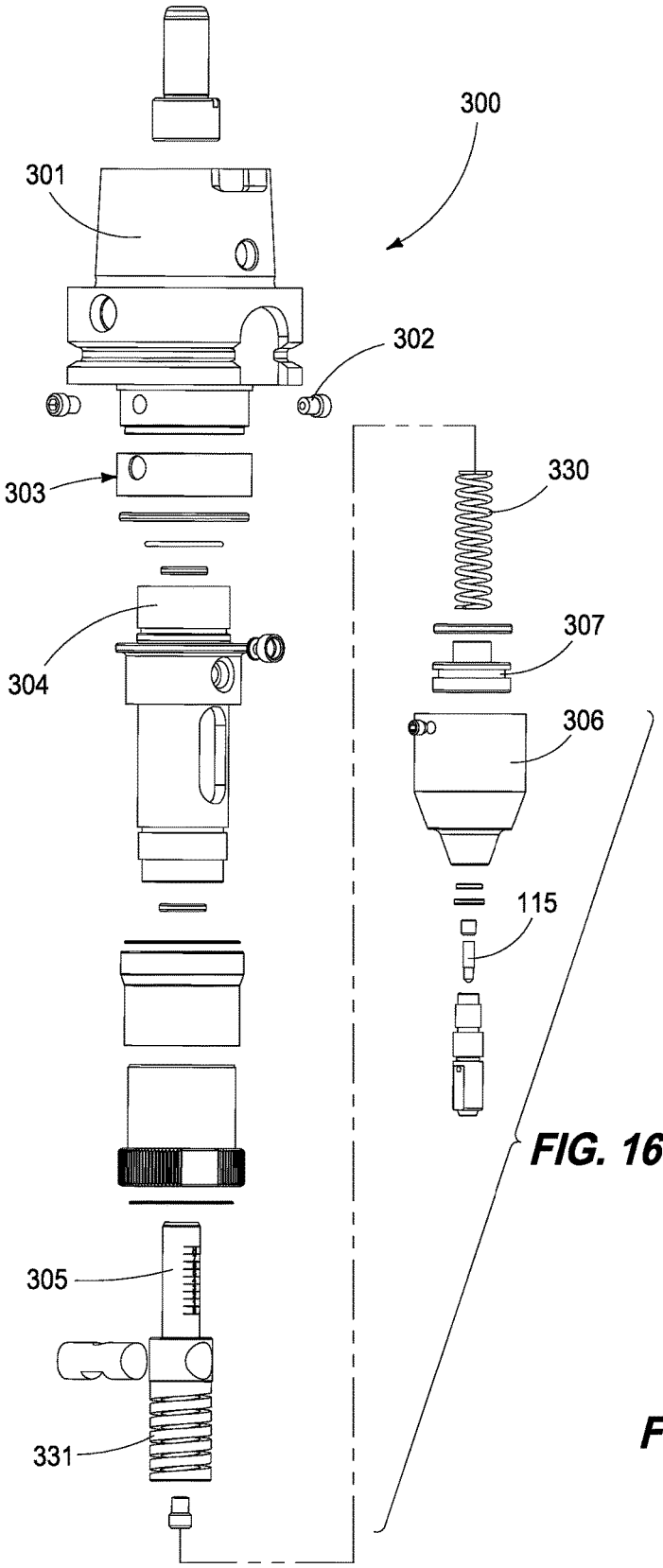
FIG. 16 is an elevation view of the embodiment of the invention illustrated in FIG. 15.

FIG. 16 is elevation view of the embodiment of the invention illustrated in FIG. 15, and illustrates stylus 115, stylus guide 306, spring 330, flexure spring with helical portion 331, force scale 305, screws 302 and stylus holder 307.

Figure 17:
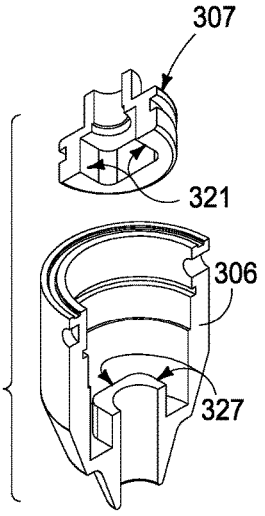
FIG. 17 is an illustration of one application of an embodiment utilizing a square within the stylus guide interacting with an internal square aperture in the stylus holder, which prevents relative rotation between the stylus holder and the stylus guide and body.

FIG. 17 is illustration of one application of an embodiment utilizing a non-circular rotation restraining member 327 within the stylus guide 306, which interacts with an internal non-circular aperture 321 which prevent relative rotation between the stylus guide 306 and the stylus driver 307.

Figure 18:
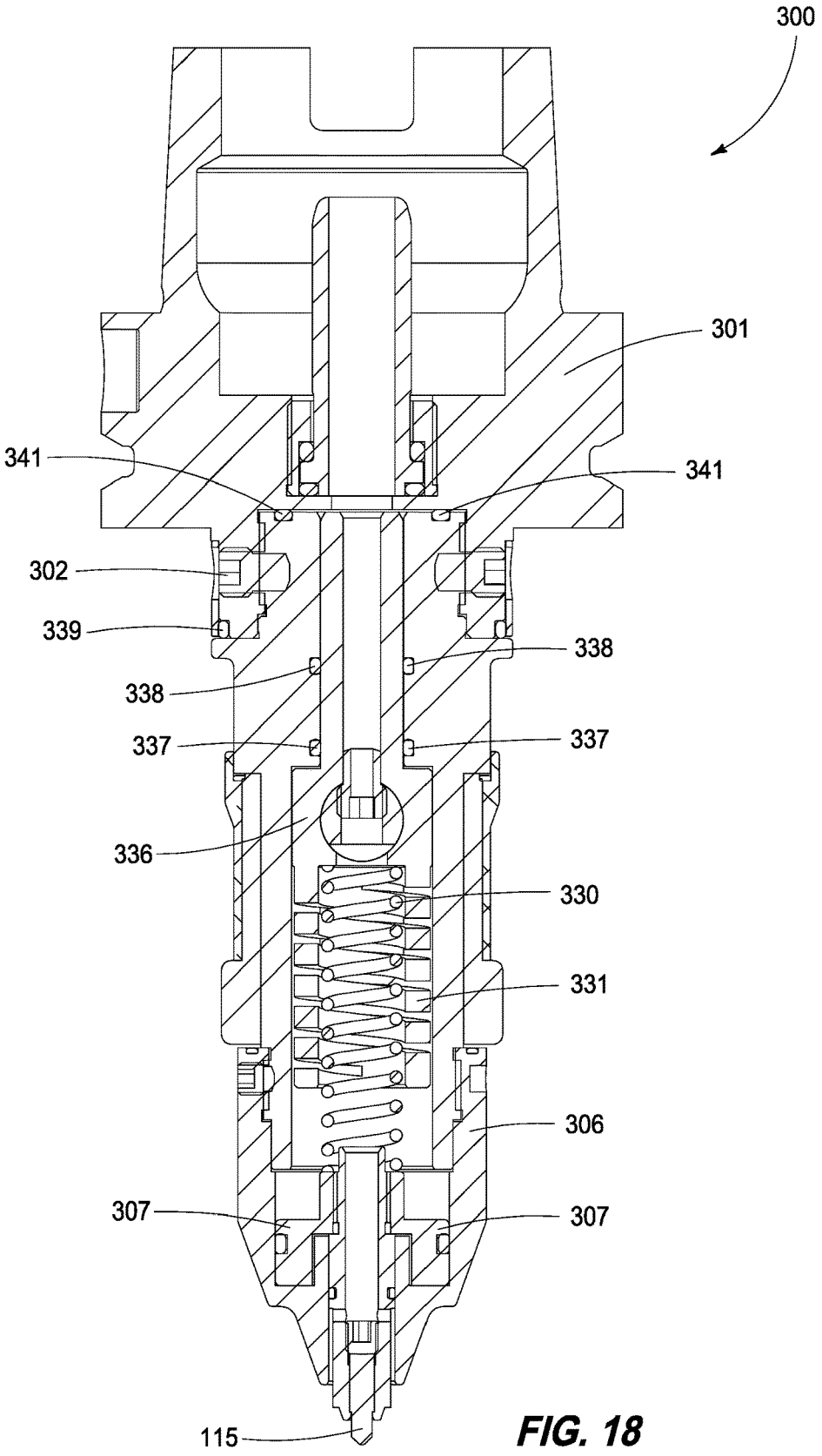
FIG. 18 is a cross-section elevation view of the embodiment of the invention illustrated in FIGS. 16-17.

FIG. 18 is a cross-section elevation view of the embodiment of the invention 300 illustrated in FIGS. 16-17, showing stylus 115, spring 330, helical portion 331 of flexure spring 336, shank 301, O-rings 341, 337 and 338, for sealing the coolant aperture, stylus guide 306, stylus holder 307. If a coolant delivery system is desired in the embodiment of the invention illustrated in FIG. 18, it would simply be the same configuration and routing as that shown in FIG. 4.

As will be appreciated by those of reasonable skill in the art, there are numerous embodiments to this invention, and variations of elements and components which may be used, all within the scope of this invention. In one embodiment for example, a scribing tool holder is disclosed which comprises: a body which includes: a top end configured to either be held in a collet or endmill tool holder of a CNC, engraving or scribing machine, or configured to be integral with a shank; a lower end that directly or indirectly operably attaches to a stylus holder; a first spring which on a lower end directly or indirectly abuts a stylus holder and on an upper end directly or indirectly abuts a compression adjustment abutment, the first spring configured to impart a biasing force on the stylus when compressed by the compression adjustment abutment; and a flexure spring with a bias force higher than the biasing force imparted by the first spring, the flexure spring directly or indirectly abutting the compression adjustment abutment on an upper end, and the flexure spring being configured to directly or indirectly abutting the stylus holder only when the adjustment abutment imposes a sufficiently higher compression biasing force to compress the first spring a distance to abut the flexure spring to the stylus holder.

In addition to the embodiment disclosed in the preceding paragraph, the invention may further include a scribing tool holder further wherein the adjustment abutment is configured to move axially within the tool holder, has external threads which operably interact with internal threads on an outer adjustment sleeve such that when the adjustment sleeve is rotated the adjustment abutment moves axially toward or away from the stylus, thereby increasing or decreasing the biasing force on the first spring and on the flexure spring; further comprising a shank portion which is integral with the body; further comprising a coolant passageway which provides a passageway for coolant to be provided through the body and outlet at or near the stylus; further comprising a stylus holder which includes a non-circular rotation restraining member within the stylus guide which interacts with a matching internal non-circular aperture which, when combined together, prevent relative rotation between the stylus guide and a stylus driver and thereby causing rotation of the stylus during operation.

In yet another embodiment to that described in the preceding paragraph, disclosed is a scribing tool holder further wherein the passageway is configured such that coolant traveling through said passageway imparts a force against a surface of the stylus holder, thereby increasing the force on the stylus against a work piece.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A scribing tool holder comprising:

a. a body which includes:

i. a top end configured to be held by a rotational device;

ii. a lower end that operably attaches to a stylus holder;

b. a first spring which on a lower end operatively imposes a spring force on a stylus holder and on an upper end operatively interacts with a compression adjustment abutment, the first spring configured to impart a biasing force on the stylus when compressed by the compression adjustment abutment; and c. a flexure spring with a bias force higher than the biasing force imparted by the first spring, the flexure spring operatively interacts with the compression adjustment abutment on an upper end, and a lower end of the flexure spring is configured to operably interact with the stylus holder only when the adjustment abutment imposes a sufficiently higher compression biasing force to compress the first spring a distance to abut the flexure spring to the stylus holder.

2. A scribing tool holder as recited in claim 1, and further wherein the adjustment abutment is configured to move axially within the tool holder, has external threads which operably interact with internal threads on an outer adjustment sleeve such that when the adjustment sleeve is rotated the adjustment abutment moves axially toward or away from the stylus, thereby increasing or decreasing the biasing force on the first spring and on the flexure spring.

3. A scribing tool holder as recited in claim 1, and further comprising a shank portion which is integral with the body.

4. A scribing tool holder as recited in claim 1, and further comprising a coolant passageway which provides a passageway for coolant to be provided through the body and outlet at or near the stylus.

5. A scribing tool holder as recited in claim 4, and further wherein the coolant is a lubricant.

6. A scribing tool holder as recited in claim 1 and further comprising a stylus holder which includes a non-circular rotation restraining member within the stylus guide which interacts with a matching internal non-circular aperture which, when combined together, prevent relative rotation between the stylus guide and a stylus driver and thereby causing rotation of the stylus during operation.

7. A scribing tool holder as recited in claim 4, and further wherein the passageway is configured such that coolant traveling through said passageway imparts a force against a surface of the stylus holder, thereby increasing the force on the stylus against a work piece.

8. A scribing tool holder as recited in claim 1, and further wherein the rotational device is one of a CNC, an engraving machine and a scribing machine.

9. A scribing tool holder as recited in claim 1, and further wherein the top end of the body is configured to be held by one of a collet or an endmill tool holder of a rotational device.

10. A scribing tool holder as recited in claim 1, and further wherein the top end of the body is integral with a shank.

11. A scribing tool holder as recited in claim 1, and further wherein the lower end of the body is operably attached directly to a stylus holder.

12. A scribing tool holder as recited in claim 1, and further wherein the lower end of the first spring operatively imposes a spring force directly on a stylus holder.

13. A scribing tool holder as recited in claim 1, and further wherein the upper end of the first spring operatively interacts with the compression adjustment abutment by directly abutting the compression adjustment abutment.

14. A scribing tool holder as recited in claim 1, and further wherein the upper end of the flexure spring operatively interacts with the compression adjustment abutment by directly abutting the compression adjustment abutment.

15. A scribing tool holder as recited in claim 1, and further wherein the lower end of the flexure spring operably interacts with the stylus holder by direct contact.

* * * * *